United States Patent [19]

Hiraki

[11] Patent Number: 4,917,063

[45] Date of Patent: Apr. 17, 1990

[54] METHOD FOR SETTING THE VEHICLE-ENGINE TORQUE

[75] Inventor: Hikosaburo Hiraki, Oyama, Japan

[73] Assignee: Kabushiki Kaisha Komatsu Seisakusho, Tokyo, Japan

[21] Appl. No.: 199,638

[22] Filed: May 27, 1988

[30] Foreign Application Priority Data

Nov. 15, 1985 [JP] Japan ..... 60-255008

[51] Int. Cl.[4] ..... F02M 39/00

[52] U.S. Cl. ..... 123/357; 123/458

[58] Field of Search ..... 123/357, 358, 359, 458, 123/419, 436

[56] References Cited

U.S. PATENT DOCUMENTS

| | | | |
|---|---|---|---|
| 4,375,668 | 3/1983 | Leung et al. | 123/419 X |
| 4,539,956 | 9/1985 | Hengel et al. | 123/436 X |
| 4,541,380 | 9/1985 | Oshizawa et al. | 123/357 |
| 4,640,241 | 2/1987 | Matsunaga | 123/357 X |
| 4,705,000 | 11/1987 | Matsumura et al. | 123/419 X |
| 4,709,335 | 11/1987 | Okamoto | 123/357 X |
| 4,766,863 | 8/1988 | Fujimori | 123/436 X |
| 4,779,595 | 10/1988 | Fujimori | 123/436 |
| 4,836,165 | 6/1989 | Kubota et al. | 123/357 |

FOREIGN PATENT DOCUMENTS

| | | | |
|---|---|---|---|
| 0235631 | 9/1988 | Japan | 123/357 |

*Primary Examiner*—Willis R. Wolfe

*Attorney, Agent, or Firm*—Armstrong, Nikaido, Marmelstein, Kubovcik & Murray

[57] ABSTRACT

A method for setting the vehicle-engine torque comprises the step of: concentrating, in lower parts of operating ranges of engine speed of the engine, any of: operating ranges of engine speed of the engine, which ranges are determined by power output characteristics inherent in the engine; and the majority of operating ranges of engine torque. The method comprises the step of: selecting an acceleration torque set value at a time when acceleration conditions of a vehicle carrying the engine is detected by a detecting means, which acceleration torque set value is larger than a normal torque set value.

3 Claims, 5 Drawing Sheets

METHOD FOR SETTING THE VEHICLE-ENGINE TORQUE

BACKGROUND OF THE INVENTION

1. Field of the Invention:

The present invention relates to a method for setting the vehicle-engine torque so as to efficiently operate the power-train components comprising an engine mounted on a vehicle in their optimum operation ranges.

2. Description of the Prior Art:

Hitherto, in a conventional motor vehicle, the engine power is transmitted to the front and/or rear wheels through the power train such as the torque converter, speed-change unit, propeller shaft, differential, and the like.

In this connection, for example, as is clear from a graph shown in FIG. 1, in locomotion of the conventional motor vehicle provided with the above power train, there is a certain relationship between traction and traveling speed of the motor vehicle. In the graph shown in FIG. 1, a torque raise is substantially within a range of from 10 to 15% in a position between a rated point "C" and a maximum-torque point "D" of the engine power output characteristics in each speed range such as 1st speed, 2nd speed, 3rd speed and the like, which torque raise is so determined as to ensure the engine durability according to requirements in engine design. On the other hand, in the speed-change unit or transmission with multiple speed ratios, each of the speed ratios between adjacent speed ranges such as those between 1st and 2nd speeds, 2nd and 3rd speeds, and like adjacent speeds of the transmission is within a range of from 1.35 to 1.40. Consequently, in order to compensate a drop in engine speed caused by such speed ratios in shifting operation of the gearshift lever of the transmission so as to keep the engine power output constant, a torque raise of from 35 to 40% is required. In a conventional vehicle engine, since the engine torque raise is within a range of from 10 to 15% as described above, the remaining part of the required torque raise is within a range of from 20 to 30% and this part is balanced or compensated for by operating the vehicle engine in its maximum engine speed regulation range. As described above, in the shifting operation, since the conventional vehicle engine is operated substantially in its maximum engine speed regulation range, the conventional vehicle engine is poor in fuel consumption for engine power output, i.e., poor in engine efficiency.

As shown in FIG. 1, the engine has its respective power output characteristics in each of the speed ranges which are shown, for example, in dotted line as to 3rd speed, in solid line as to 4th speed, and in one-dotted chain like as to 5th speed. In addition, in the case of 4th speed, the operating range of engine speed is defined between a point "$P_1$" at which the engine power output curve of the 4th speed crosses that of the 3rd speed and a point "$P_2$" at which the engine power output curve of the 4th speed crosses that of the 5th speed as shown in FIG. 1. On the other hand, as for the engine torque, the operating range of the engine torque is also defined between these points "$P_1$" and "$P_2$".

Furthermore, it is known that the operating range in the vicinity of a point "D" at which the maximum engine power output is obtained is generally most suited for operation of the engine in improvement of the engine efficiency in any of the speed ranges.

However, as described above, in the conventional engine, the engine is operated substantially in its maximum engine speed regulation range in which the engine efficiency is poor. In addition, since frictional power loss produced in the power trains comprising a torque converter, transmission and like components varies with 1 to 2 power of engine speed, the conventional engine is disadvantageous in both of engine efficiency and power loss.

SUMMARY OF THE INVENTION

It is an object of the present invention to provide a method for setting the vehicle-engine torque so as to operate a vehicle engine and power trains in optimum conditions or most effective operation ranges.

The above object of the present invention is accomplished by providing:

A method for setting the vehicle-engine torque comprising the step of:

concentrating, in lower parts of operating ranges of engine speed of said engine, any of: operating ranges of engine speed of said engine, said ranges being determined by power output characteristics inherent in said engine; and the majority of operating ranges of engine torque.

It is another object of the present invention to provide:

A method for setting the vehicle-engine torque comprising the step of:

selecting an acceleration torque set value at a time when acceleration conditions of a vehicle carrying an engine is detected by a detecting means, said acceleration torque set value being larger than a normal torque set value.

The above and many other advantages, features and additional objects of the present invention will become manifest to those versed in the art upon making reference to the following detailed description and accompanying drawings in which preferred embodiment incorporating the principles of the present invention are shown by way of illustrative example.

DESCRIPTION OF THE PREFERRED EMBODIMENT

A preferred embodiment for working the method of the present invention for setting the vehicle-engine torque will be described hereinbelow with reference to the accompanying drawings: FIGS. 2 to 6.

Figure 1:
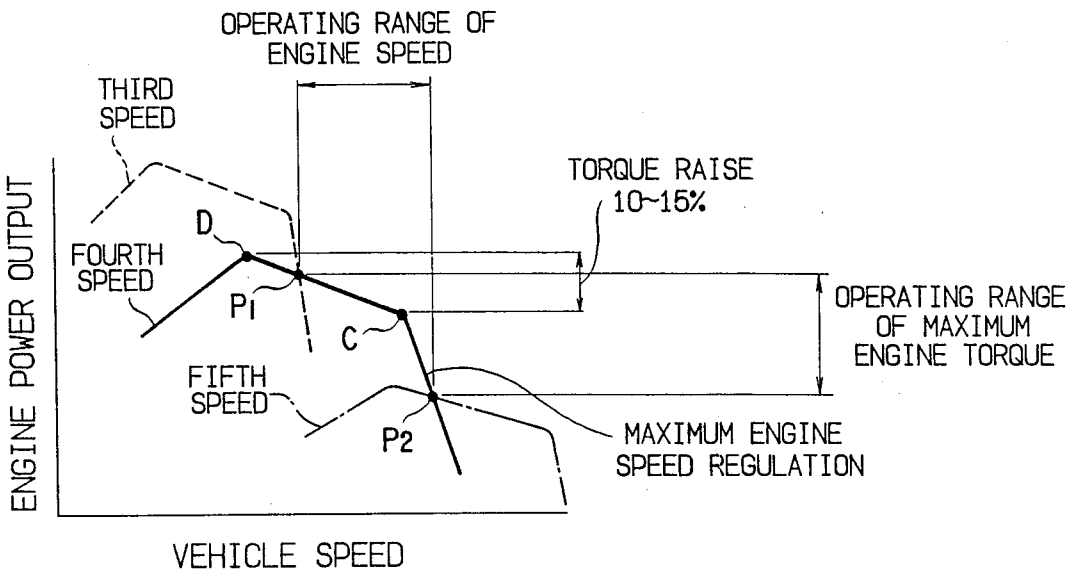
FIG. 1 is a graph showing the curves of the engine power output characteristics in the 3rd speed, 4th speed and 5th speed of the transmission of the conventional engine.
Figure 2:
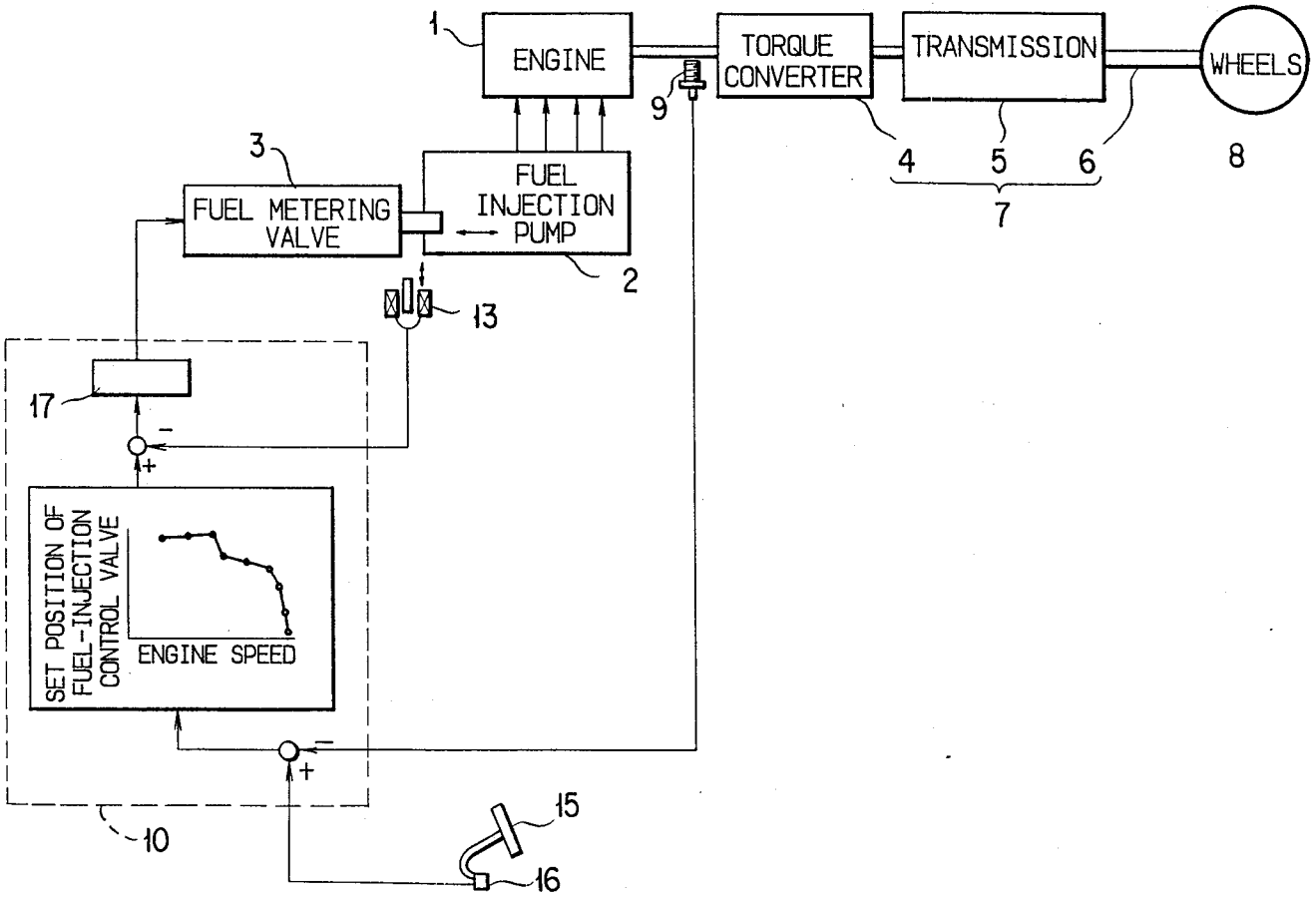
FIG. 2 is a schematic diagram illustrating the engine control system of the present invention.
Figure 3:
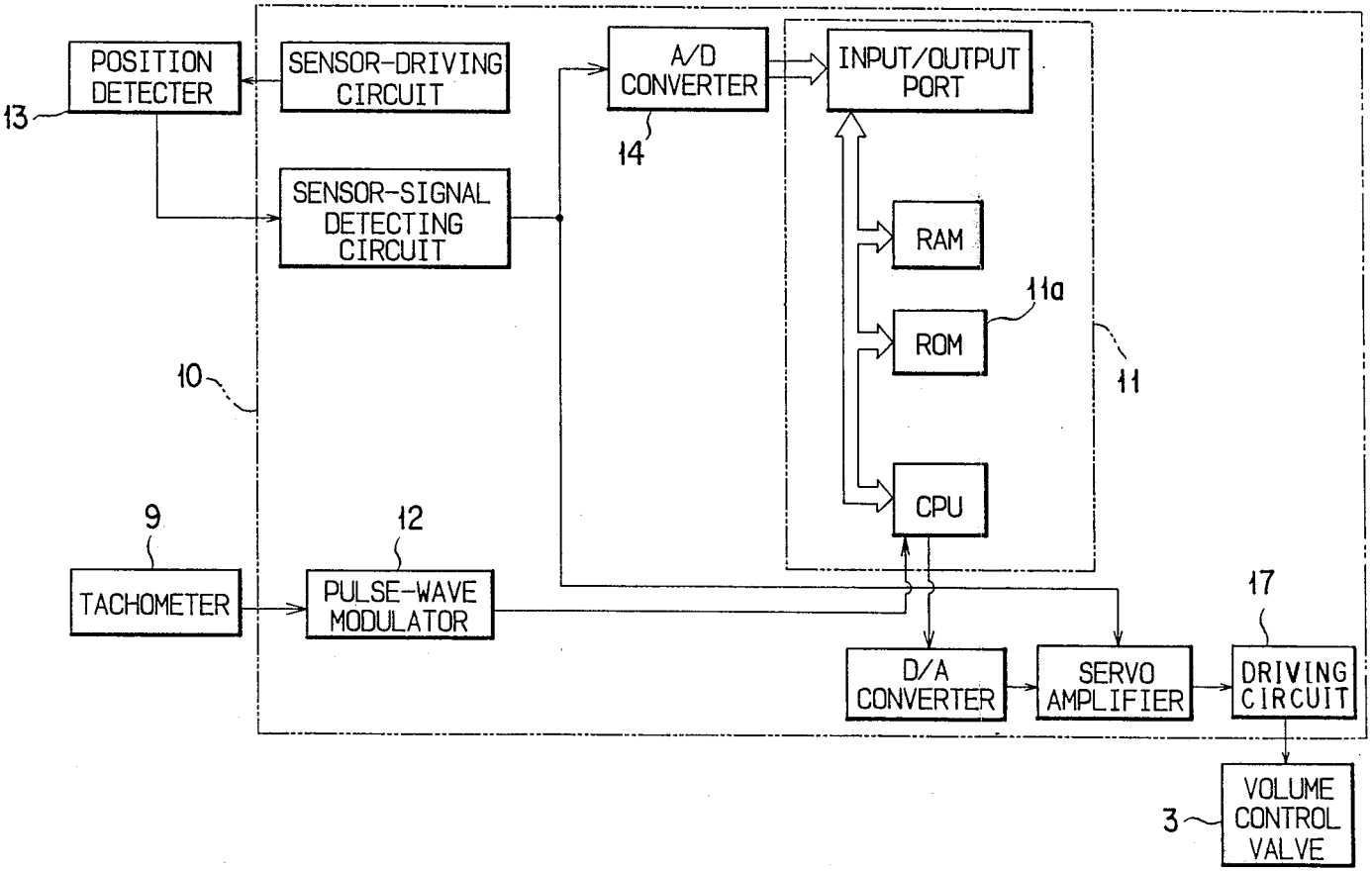
FIG. 3 is block diagram of an electronic control unit employed in the engine control system of the present invention.

In FIG. 2: the reference numeral 1 denotes an engine mounted on a vehicle such as construction machinery (not shown); 2 a fuel injection pump of the engine 1; and 3 a volume control valve or fuel metering valve for controlling a volume of fuel to be injected. The power output of the engine 1 is transmitted to wheels 8 through a power train 7 constructed of power-train components such as a torque converter 4, transmission 5, propeller shaft 6 and the like. In the power output side of the engine 1 is provided a revolution sensor or tachometer 9 which detects an engine speed and issues an engine-speed signal or pulse signal to an electronic control unit 10. As shown in FIG. 3, this unit 10 is constructed of a microcomputer 11. In the unit 10, the pulse signal issued from the tachometer 9 is modulated in a pulse-wave modulator 12, and thereafter issued to the microcomputer 11.

On the other hand, operating positions of the volume control valve 3 for controlling the volume or quantity of fuel to be injected to the engine 1 by means of a fuel injection pump 2 are detected as analog signals by a variable-inductance-type position detector 13 such as a differential transformer, and then converted into digital signals by means of an A/D converter 14. The thus produced digital signals are received by the microcomputer 11 so that signals for controlling the fuel metering valve 3 are calculated on the basis of: operating-position signals of an accelerator pedal issued from an operating-position detector 16 which is provided in an accelerator-pedal assembly 15; and the above engine-speed signals issued from the tachometer 9 of the engine 1.

Figure 5:
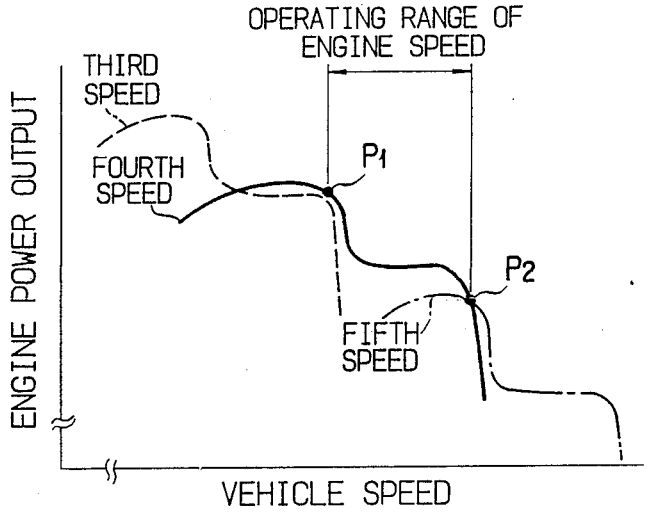
Figure 6:
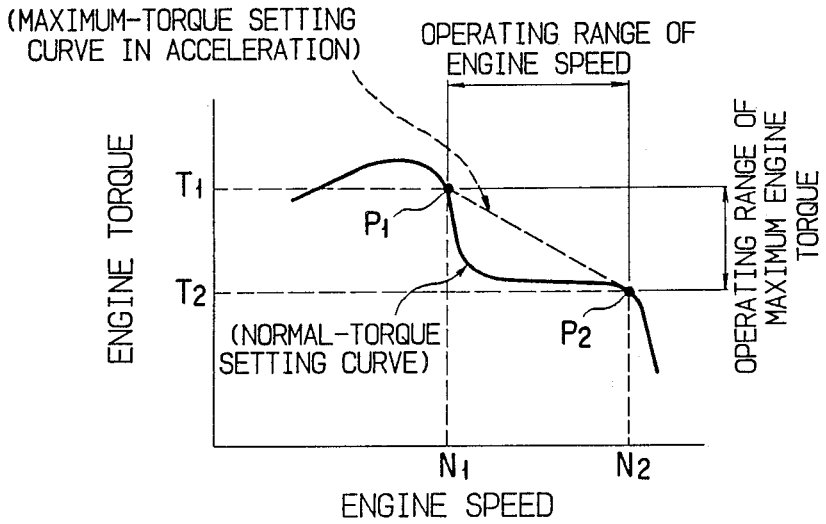

Now, with reference to FIGS. 4 to 6, the embodiment of the present invention will be described in detailed as to its controlling operation.

In a memory 11*a* of the electronic control unit 10, a map, which defines the relationship between engine speed of the engine 1 and set positions of the fuel metering valve 3 for metering maximum quantity of fuel to be injected, is so set as to correspond to engine torque setting of the engine 1.

Figure 4:
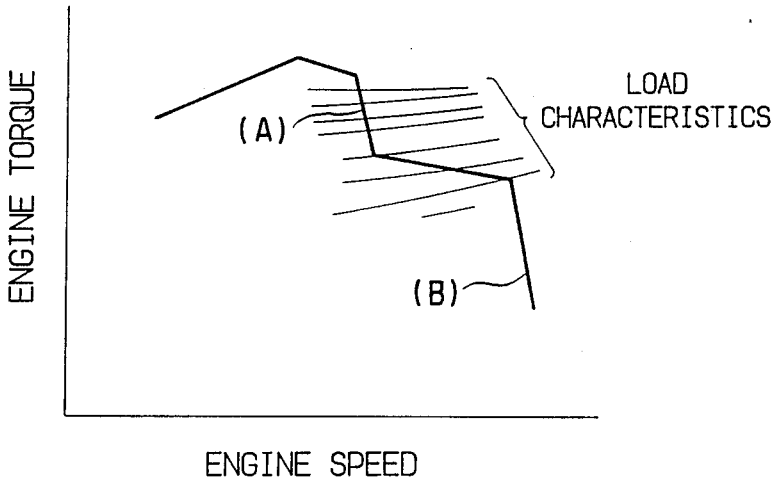
FIGS. 4 to 6 are graphs for illustrating the method of the present invention for setting the vehicle-engine torque.

Namely, as shown in FIG. 4, in the engine torque setting of the engine 1, the regulation range of the engine 1 comprises a low-speed regulation range (A) and a maximum-speed regulation range (B). In order to more match the engine torque to the torque demand set by operating conditions, among the operating range of engine speeds of from "$N_1$" to "$N_2$" determined by the engine power output characteristics and the operating range of maximum engine torque of from "$T_1$" to 37 $_2$", at least 50% of the operating range of engine torque is concentrated in the low-speed regulation range (A) shown in FIG. 4. In this connection, FIGS. 5 and 6 should be referred.

The above arrangements make it possible to conduct the following control.

Under a condition in which the engine 1 runs at an engine speed set by the accelerator pedal assembly 15, the engine speed is detected by the revolution sensor or tachometer 9 which issues a signal to the electronic control unit 10 in which the engine speed set by the accelerator pedal assembly 15 is compared with the actual engine speed. In case that there is any difference between them in the above comparison, the operating position of the fuel metering valve 3 is calculated on the basis of the engine speed with reference to the map stored in the memory 11*a*, and then compared with the signal issued from the position detector 13 of the fuel metering valve 3. If there is any difference between them in such comparison, a control signal is issued to a driving circuit 17 to cause the same 17 to control the fuel metering valve 3 so as to inject the fuel into the engine 1 by an amount corresponding to the engine speed set by the accelerator pedal assembly 15.

However, as for the engines employed in the construction machinery and like vehicle, in order to do maximum work per unit time, the accelerator pedal is usually set in its maximum operating position so that engine torque is matched to the torque demand in normal operating conditions according to the engine torque characteristics determined by the operating position of the fuel metering valve 3 for injecting a maximum amount of fuel with respect to the engine speed. The present invention relates to the improvement in case that the matching characteristics of the engine are determined only by the operating position of the fuel metering valve for injecting a maximum amount of fuel.

In the above control operation of the engine, since engine torque is set in the low-speed regulation range (A) during the normal operation thereof, it is possible to operate the engine 1 in its optimum conditions in which the engine 1 produces maximum engine torque.

On the other hand, as is in starting and acceleration operations of dump trucks and like vehicles, when the accelerator pedal assembly 15 is rapidly operated, the engine speed is also rapidly increased. At this time, when the engine 1 is recognized to be in acceleration conditions, the engine torque setting is changed to the maximum engine torque setting in acceleration as shown in dotted line of FIG. 6, whereby it is possible to obtain acceleration performance similar to that obtained hitherto. In this connection, in order to recognize whether the engine 1 is in acceleration conditions, the engine speed obtained by differentiating, in the microcomputer 11, the pulse signal issued from the tachometer 9 and modulated in the pulse-wave modulator 12 is compared with a predetermined set value, and, when the thus obtained engine speed is larger than such predetermined set value it is possible to recognize that the engine 1 is in acceleration conditions.

Incidentally, in the above embodiment of the present invention, although the engine speed of the engine 1 is controlled by means of the accelerator pedal assembly 15, it is also possible to control the engine speed of the engine 1 by means of an accelerator lever assembly (not shown).

According to the method of the present invention for setting the engine torque, it is possible to most efficiently operate the engine 1 so as to improve the engine 1 in its fuel consumption and in noise. In addition, it is also possible to reduce the power loss produced in the power trains comprising the torque converter, transmission and like power-train components.

What is claimed is:

1. A method for setting vehicle-engine torque, comprising the steps of:

determining operating ranges of engine speed by power output characteristics in said engine, said operating ranges having lower portions;

concentrating, in said lower portions of said operating ranges of said engine speed, at least one of said operating ranges of engine speed, and a majority of operating ranges of engine torque; and setting said vehicle-engine torque relative to said concentrated operating ranges of said engine speed.

2. The method for setting vehicle-engine torque as set forth in claim 1, further comprising the steps of:

detecting conditions by a detector for acceleration of a vehicle having said engine; and selecting an acceleration torque set value at a time when acceleration conditions of said vehicle having said engine is detected by said detector, said acceleration torque set value being larger than a normal torque set value.

3. The method for setting vehicle-engine torque as set forth in claim 2, wherein said step of detecting conditions for vehicle accelerating includes the step of comparing engine speed value and set engine speed value.

* * * * *